United States Patent [19]

Rösler

[11] 4,210,253

[45] Jul. 1, 1980

[54] PACKING CONTAINER FOR ELONGATED OBJECTS

[76] Inventor: Peter Rösler, Thumen 110, D 8995 Sigmarszell, Fed. Rep. of Germany

[21] Appl. No.: 40,474

[22] Filed: May 18, 1979

[30] Foreign Application Priority Data

May 19, 1978 [DE] Fed. Rep. of Germany ... 7815027[U]

[51] Int. Cl.[2] ..... B65D 11/02; B65D 85/54

[52] U.S. Cl. ..... 220/8

[58] Field of Search ..... 220/8, 4 R, 4 C, 4 E, 220/288; 229/93

[56] References Cited

U.S. PATENT DOCUMENTS

| | | | |
|---|---|---|---|
| 193,686 | 7/1877 | Bowers | 220/8 |
| 2,416,142 | 2/1947 | Bennett | 220/8 |
| 3,819,040 | 6/1974 | Coons | 220/8 |

FOREIGN PATENT DOCUMENTS

| | | | |
|---|---|---|---|
| 2431672 | 1/1976 | Fed. Rep. of Germany | 220/8 |

*Primary Examiner*—George E. Lowrance

*Attorney, Agent, or Firm*—Toren, McGeady and Stanger

[57] ABSTRACT

A packing container is formed of a pair of cylindrically shaped axially elongated hollow bodies disposed in coaxial alignment with one fitting telescopically into the other. A row of teeth is formed on and projects outwardly from the inner hollow body and the row extends in parallel with and for the full axial extent of the inner hollow body. The teeth extend in the circumferential direction of the inner hollow body. However, the teeth extend for only a fractional angular portion of the circumferential dimension of the inner hollow body. Threads are formed on the inner surface of the outer hollow body adjacent its open end and the teeth interengage with the threads. Both the teeth and threads extend at the same oblique angle to the longitudinal axis of the hollow bodies. The teeth have a rectangular cross-sectional shape while the threads are formed as buttress threads.

10 Claims, 6 Drawing Figures

PACKING CONTAINER FOR ELONGATED OBJECTS

SUMMARY OF THE INVENTION

The present invention is directed to an elongated packing container made up of two cylindrically shaped hollow bodies telescopically insertable one into the other and each hollow body is closed at one end and is open at the other end. In the assembled state, one hollow body extends into the other for at least a portion of its length and the inner hollow body is provided with a row of teeth extending for the length of the hollow body with the teeth projecting outwardly from the outer surface of the hollow body. The teeth extend for only a small angular portion of the circumferential dimension of the hollow body and they extend transversely of the longitudinal axis of the hollow body. The row of teeth extends parallel to the longitudinal axis of the hollow body. When assembled, the teeth engage similar counterparts at the open end of the outer hollow body.

If objects of different lengths are to be packed in a container so that they perform no or only small axial movements, it is necessary to provide a container adaptable to the lengths of the objects. As a result, a number of packing containers is required for a plurality of objects of different lengths. Such a requirement not only increases the packing costs, since different molds or tools are needed for production, but additionally storage costs are increased, since it is necessary to retain a certain supply. Moreover, there is the additional problem in drills or the like that such objects have large circumferential or cross-sectional dimensions relative to the length dimension.

To satisfy the need for a reduction in the number of parts of a container used for packing objects of different lengths and/or cross-section, there is a known container which is used for packing objects of different lengths over a wide range. Both parts of the container are the same for a certain broad range of lengths, accordingly, objects ranging from a certain base length to twice that length can be packed in the same container. In such a packing arrangement, a first part of the container is slidably received in a second part with its outer wall in contact with the inner wall of the second part. The first part has a groove which extends from its open end and is parallel to its longitudinal axis. The groove leads into locking grooves extending transversely of the groove. A detent is provided on the second part so that it can move through the longitudinal groove and into the locking grooves by a rotational movement. The detent is located at the open end of the second part.

There is a known packing container, note German Offenlegungsschrift No. 24 31 672, German Utility Model No. 74 22 445 which consists of an inner hollow body and an outer hollow body. The outer hollow body has at least one row of teeth formed on its inner surface extending over its full length while the inner hollow body is provided adjacent its open end on its outer surface with a projection extending over a part of its length and engageable with the row of teeth. Such a packing container has certain disadvantages primarily concerned with the inability to afford a satisfactory engagement between the projection and the teeth.

In another packing container disclosed in German Utility Model No. 76 20 793, two hollow bodies, each having an open end and a closed end, fit one into the other so that a sliding movement of one relative to the other is possible in the axial direction. One hollow body has locking teeth which extend over its entire length and the other hollow body has a cooperating part at its open end which engages with the locking teeth. While the locking teeth are located on the outer surface of the inner hollow body, the cooperating part on the outer hollow body is an annular indentation which encircles the outer hollow body adjacent its open end.

Based on this known state of the art, the primary object of the present invention is to provide a container formed of two parts for packing elongated objects so that objects of varying lengths and diameters can be accepted within one container and the packing can be accomplished automatically. For another range of dimensions, it is merely necessary to change the lengths and diameters of the two container parts with the design principle and the possibility of automatic packing remaining the same. It is considered especially important to ensure a problem-free, secure interconnection of the two parts of the container even when it is exposed to rough handling for affording a satisfactory clamping action on an elongated item held within the container.

In accordance with the present invention, a two-part packing container has teeth formed on the outer surface of the inner body with the teeth disposed at an angle to the axis of the body. Further, the outer hollow body has threads which cooperate with the teeth formed around the hollow body for a short portion of its axial length. Each thread is inclined to the longitudinal axis of the outer hollow body at the same angle as the teeth extend relative to the axis of the inner body.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2, 3, 4, 5, 6:
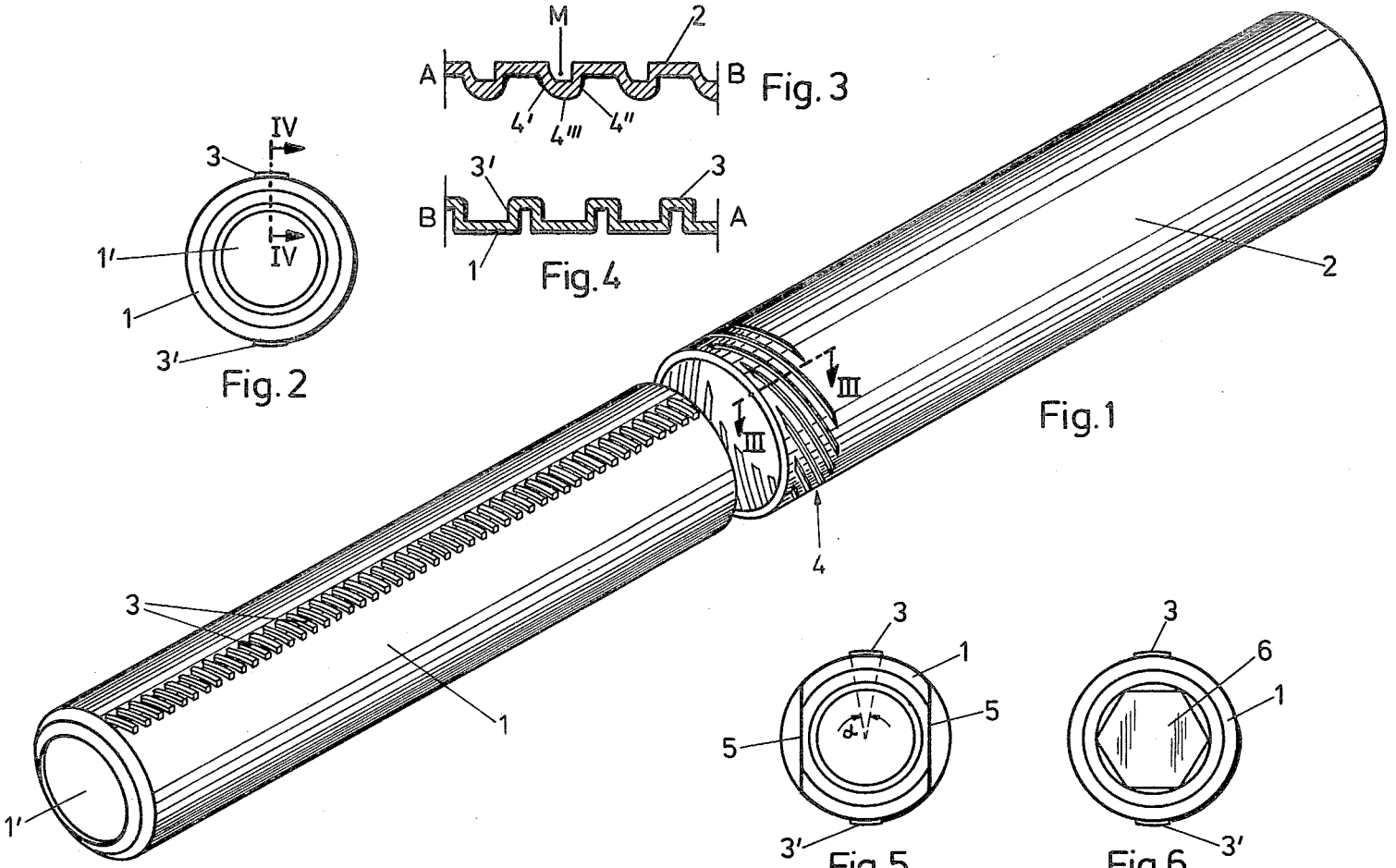
FIG. 1 is a perspective view of two hollow bodies forming a packing container with one body arranged to extend telescopically into the other.
FIG. 2 is an end view of the closed end of the inner hollow body.
FIG. 3 is a sectional view taken along the line III—III in FIG. 1.
FIG. 4 is a sectional view taken along the line IV—IV in FIG. 2.
FIGS. 5 and 6 are additional embodiments of the closed end of the inner hollow body shown in FIG. 2.

In FIG. 1 a packing container is illustrated formed of a first or inner hollow body 1 and a second or outer hollow body 2. Each hollow body has a closed end, note closed end 1' of the inner hollow body, the closed end of the outer hollow body is not visible. The ends of the hollow bodies facing one another in the position shown in FIG. 1 are open so that the inner hollow body 1 can move telescopically into the outer hollow body 2. As a result of the telescoping feature of the packing container, the inner hollow body 1 has a smaller outside diameter than the outer hollow body 2. To provide the requisite telescoping action, the inner diameter of the outer hollow body 2 is slightly greater than the outer diameter of the inner hollow body 1. As can be seen in FIG. 1, the inner hollow body 1 has at least one row of teeth 3 which extends parallel to the longitudinal axis of the hollow body and also for its full axial length. The teeth 3 project outwardly from the cylindrical outer surface of the inner hollow body 1 and extend for a small angle $\alpha$ about the circumferential direction and the teeth extend transversely of the longitudinal axis.

Adjacent its open end, the hollow body 2 has a threaded part 4 which cooperates with the teeth 3 to afford a connection between the two hollow bodies.

In accordance with the present invention, the teeth 3 are disposed at an oblique angle to the longitudinal axis of the inner hollow body 1 while the threaded part 4 extends completely around the inner circumference of the outer hollow body 2 and the individual threads which extend for only a portion of the circumferential direction are disposed at the same oblique angle to the longitudinal axis of the outer hollow body 2 as the teeth 3 are inclined to the axis of the inner hollow body 1.

As shown in FIG. 4, the teeth 3 projecting outwardly from the inner hollow body 1, have a rectangular cross-section as viewed along the line IV—IV in FIG. 2. Each of the individual threads on the threaded portion 4 of the outer hollow body is in the form of a buttress thread, note FIG. 3. In each of FIGS. 3 and 4 reference character A designates the open end of the hollow body and reference character B designates the closed end. As viewed in FIG. 3, the flanks 4' facing toward the open end A of the outer hollow body 2 are inclined obliquely relative to the longitudinal axis of the hollow body, while the opposite flanks 4'', facing toward the closed end B of the hollow body extend substantially perpendicularly relative to the axis of the hollow body. A circular or rounded crest 4''' interconnects each of the flanks 4', 4'' of the individual threads of the threaded portion 4. The center M of the rounded crests 4''' is located on the root circle of the thread against which the crest surface of the teeth 3 abut or to which the surfaces are juxtaposed.

The individual threads of the threaded portion 4 extend inwardly from the inner surface of the outer hollow body 2 into the path of the teeth 3 as the inner hollow body moves into the outer hollow body. As can be seen in FIG. 1 each individual thread only extends about an angular part of the circumferential demension of the outer hollow body.

The shaped configuration of the teeth 3 and of the individual threads of the threaded portion 4 is of particular importance regarding interconnecting the two hollow bodies in a problem-free manner. Preferably, the hollow bodies are made of a deformable, elastic plastics material. Accordingly, it is possible to press the inner hollow body 1 in a telescopic manner into the outer hollow body 2 with the teeth 3 sliding over the inclined flanks 4' and the rounded crests 4''' until the closed end 1' of the inner hollow body 1 contacts the object located in and projecting out of the open end of the outer hollow body 2. When this point is reached, by a slight rotation of the inner hollow body 1 relative to the outer hollow body 2 about the longitudinal axis of the hollow bodies, that is, a clockwise rotation as shown in the example, the teeth 3 which are in engagement with the threaded portion 4 provide a locking action. The flanks 3' of the teeth facing toward the closed end of the inner hollow body 1 are disposed in rigid engagement with the flanks 4'' facing toward the closed end of the outer hollow body 2. Subsequently, as depicted in the example, a counterclockwise rotation of the inner hollow body relative to the outer hollow body must be effected for releasing the locking action. If the material forming the hollow bodies is sufficiently elastic, the inner body can be pulled out of the outer body, or if it lacks such elasticity, the inner body can be screwed out of the outer body. The closed end faces of either of the hollow bodies, but preferably of both hollow bodies, are provided with surfaces 5 or 6 spaced outwardly from and extending chordally of the longitudinal axis of the bodies so that a tool can be placed in contact with such surfaces for rotating one of the hollow bodies relative to the other. FIGS. 5 and 6 display examples of the surfaces 5, 6. Further, it is particularly advantageous if the ends of the two hollow bodies are resilient, preferably they should have an outwardly directed slight arc or curvature. This feature helps to hold securely the object packed in the container, to reinforce the clamping action of the interconnection between the teeth and the individual threads, and to obtain a positive and secure engagement between the two hollow bodies.

Preferably, the inner hollow body has two rows of teeth 3 and 3', note FIG. 5, with the rows located diametrically opposite one another on the outer surfaces of the inner hollow body.

As can be seen in FIG. 5, the circumferential angle $\alpha$ of the teeth 3, 3' is preferably in the range of 15° to 30°.

From the foregoing description it can be appreciated that a versatile packing container is afforded by the present invention. The packing container can be used for a wide range of objects having varying lengths and diameters. Such objects can be held in a simple but extremely secure manner within the closed containers so they do not move in the containers. Additionally, it should be noted that it is possible to produce hollow bodies of any desired length by means of two tools, one for the inner hollow body 1 and the other for the outer hollow body 2. As a result, it is possible to pack and lock an object in a closed packing container over a wide range with respect to the diameter of the objects.

While specific embodiments of the invention have been shown and described in detail to illustrate the application of the inventive principles, it will be understood that the invention may be embodied otherwise without departing from such principles.

What is claimed is:

1. Elongated packing container comprising a first and second cylindrically shaped axially elongated hollow body each having a closed end and an open end with the open end of said first hollow body telescopically insertable into the open end of and being coaxial with said second hollow body, said second hollow body being capable of telescopically receiving at least a part of the axial length of said first hollow body, said first hollow body has a row of teeth with the row extending for substantially the full axial length of said first hollow body and being parallel with the longitudinal axis thereof, said teeth extending outwardly from the outer surface of said first hollow body, each of said teeth extending substantially transversely of the axial direction of said first hollow body and in the circumferential direction of said first hollow body for a small angular extent thereof, and means on said second hollow body adjacent the open end thereof for engagement with said teeth on said second hollow body, wherein the improvement comprises that said teeth are disposed at an oblique angle to the longitudinal axis of said first hollow body, said means on said second hollow body comprises an annular portion of individual threads having a short axial length relative to the length of said row of teeth and to the axial length of said second hollow body, said threads being inclined to the longitudinal axis of said second hollow body at substantially the same angle as said teeth form with the longitudinal axis of said first hollow body, and said threads extending inwardly from the inner surface of said second hollow body.

2. Elongated packing container, as set forth in claim 1, wherein said teeth on said first hollow body have a rectangular cross-section in the axial direction of said first hollow body.

3. Elongated packing container, as set forth in claim 1, wherein said threads are shaped as buttress threads each having a first flank facing toward the open end of said second hollow body and a second flank facing toward the closed end of said second hollow body, said first flank extending from the root thereof is inclined toward the closed end and at an oblique angle to the longitudinal axis of said second hollow body and said second flank extends from the root thereof substantially perpendicularly to the longitudinal axis of said second hollow body.

4. Elongated packing container, as set forth in claim 3, wherein each of said threads has a crest portion extending between the ends of said first and second flanks remote from the roots thereof and said crest portions have a convex rounded shape.

5. Elongated packing container, as set in claim 4, wherein the center of each of said rounded crest portions is located on the root circle of said threads which are in juxtaposition to the outer crest surfaces of said teeth of said first hollow body.

6. Elongated packing container, as set forth in claim 1, wherein the closed end of at least one of said first and second hollow bodies has oppositely disposed surfaces located outwardly from and extending chordally of the longitudinal axis thereof for engagement with a tool for effecting rotation of the one of said hollow bodies relative to the other.

7. Elongated packing container, as set forth in claim 1, wherein two said rows of teeth are formed on said first hollow body with said rows located diametrically opposite one another.

8. Elongated packing container, as set forth in claim 1, wherein said teeth extend in the circumferential direction for an angle relative to the longitudinal axis of said inner body in the range of 15°–30°.

9. Elongated packing container, as set forth in claim 1, wherein said first and second hollow bodies are formed of a deformable elastic plastics material.

10. Elongated packing container, as set forth in claim 1, wherein said closed end faces of said first and second hollow bodies are formed of a resilient material and have a slightly outwardly directed curved configuration.

* * * * *